United States Patent [19]

Behrens

[11] Patent Number: 4,583,390

[45] Date of Patent: Apr. 22, 1986

[54] APPARATUS FOR SQUEEZING OFF AND REROUNDING PIPE

[76] Inventor: Robert N. Behrens, 4802 W. Laurel La., Glendale, Ariz. 85304

[21] Appl. No.: 713,414

[22] Filed: Mar. 18, 1985

[51] Int. Cl.[4] ..... B21D 37/10

[52] U.S. Cl. ..... 72/416; 72/30; 72/389; 72/399; 72/455

[58] Field of Search ..... 72/30, 384, 386, 389, 72/399, 415, 416, 455

[56] References Cited

U.S. PATENT DOCUMENTS 3,117,615 1/1964 Graven ..... 72/416

3,266,287 8/1966 Gill ..... 72/416

*Primary Examiner*—W. D. Bray

*Attorney, Agent, or Firm*—H. Gordon Shields

[57] ABSTRACT

Apparatus for squeezing off pipe and then for rerounding the squeezed off pipe includes a frame having a fixed portion and a movable portion which utilize a pair of pins for squeezing off the pipe. A pair of rerounding fixtures are placed on the pins for rerounding the squeezed-off pipe. Both plastic and metal pipe may be squeezed off and rerounded with the apparatus. Hydraulic pressure is used for both the squeezing off and the rerounding forces.

14 Claims, 12 Drawing Figures

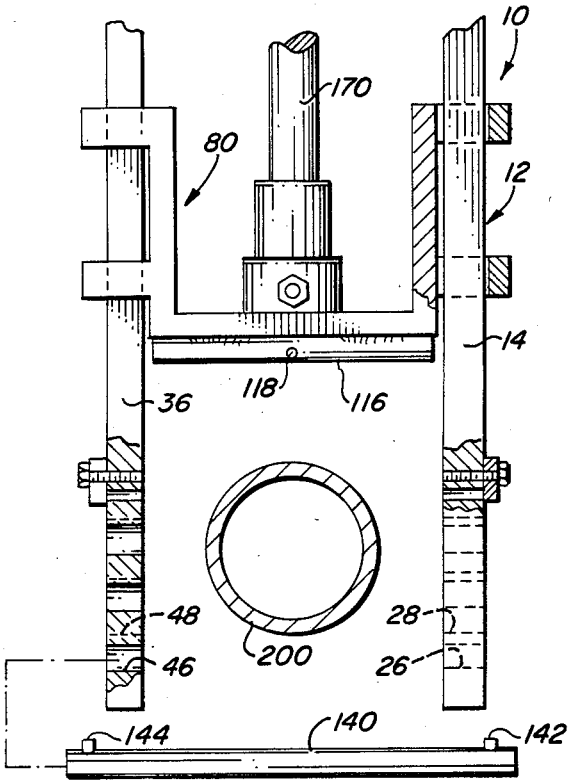
FIG. 6
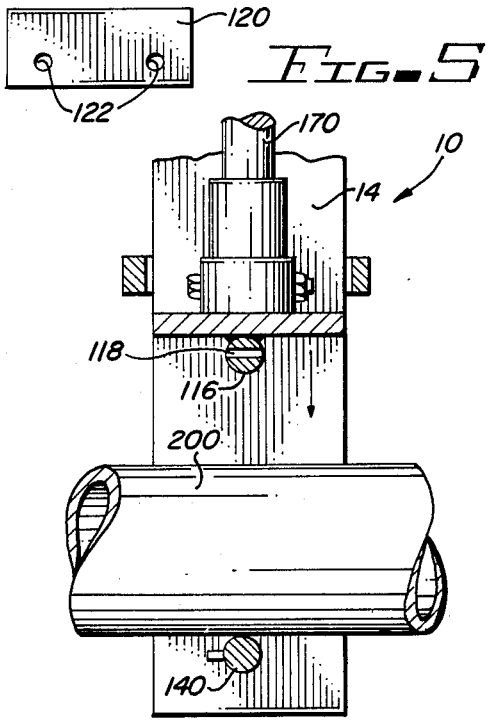
FIG. 5
FIG. 7
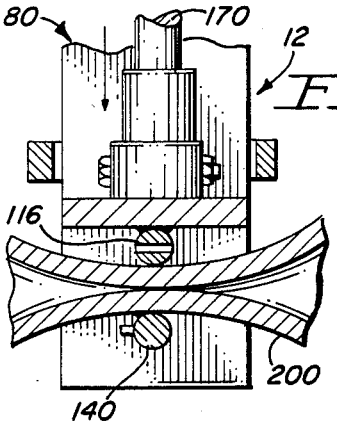
FIG. 8
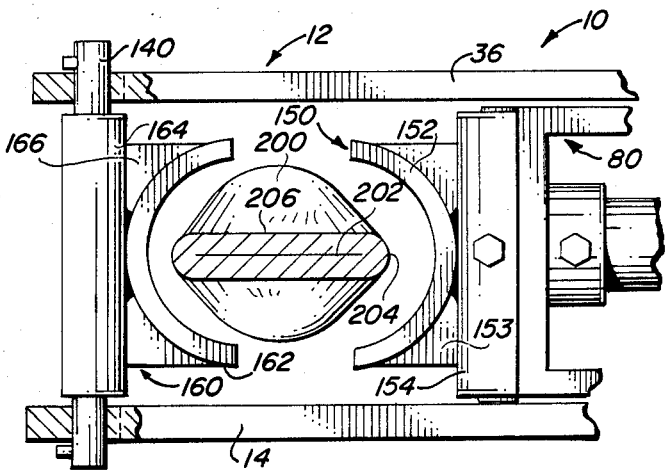
FIG. 10
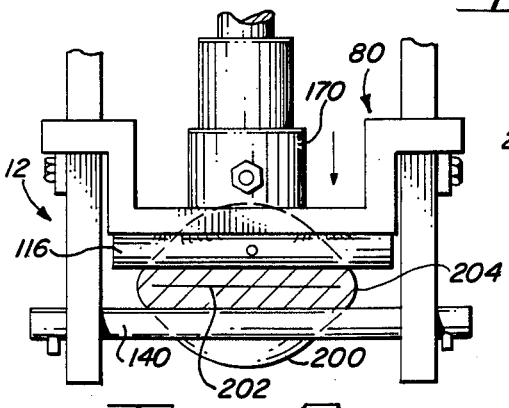
FIG. 9
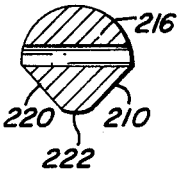
FIG. 12
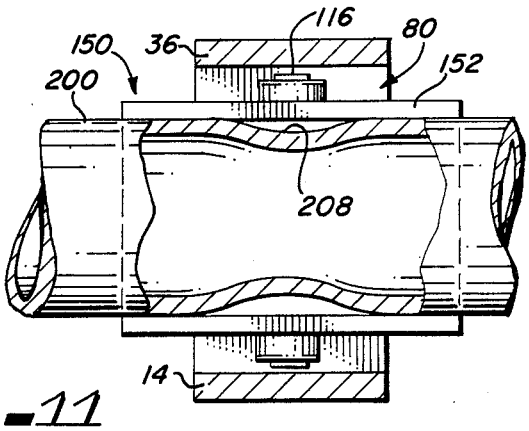
FIG. 11

APPARATUS FOR SQUEEZING OFF AND REROUNDING PIPE

BACKGROUND OF THE INVENTION

1. Field of the Invention

This invention relates to squeezing pipe and to rerounding the squeezed pipe and, more particularly, to a single apparatus capable of both squeezing off pipe and then rerounding the squeezedoff pipe.

2. Description of the Prior Art

U.S. Pat. No. 134,349 discloses apparatus for forming rings around a mandrel. The die for forming the rings includes two semicircular portions which are forced together around the mandrel, and the ring to be formed is pressed by and between the dies and around the mandrel to form the ring. While this patent does not relate to the present apparatus, it discloses apparatus for forming a metal ring around a cylindrical mandrel, and the forming dies are each semicircular in configuration.

U.S. Pat. No. 467,657 discloses a hydraulic system for forming metal rings or bands around artillery shells. The apparatus comprises four hydraulic cylinders spaced ninety degrees apart and each connected to a die. Each die comprises a quarter of a circle, and the four dies together form a complete circle. The cylinders and dies are spaced ninety degrees apart from each other and are located on a common center. As the cylinders and dies move inwardly, the metal ring is formed around the centered artillery shell.

U.S. Pat. No. 694,177 discloses apparatus for straightening dents in cans by having a fixed concave die surface and a movable die member which has a mating convex surface. Cans to be straightened are placed on a concave die, and the convex die is then moved against the can to press the dent out of the can by forcing the dented metal between the convex and concave die portions.

U.S. Pat. No. 889,728 discloses apparatus for reducing the diameter of the ends of boiler tubes. The apparatus includes two die portions, a lower fixed die and an upper, movable die, each of which is concavely semicircular in configuration. The upper semicircular die is pressed downwardly against the fixed semicircular die. The end of the tube to be diametrically reduced is disposed on the bottom die, and when the upper die is forced downwardly, the reduction in diameter occurs.

U.S. Pat. No. 1,879,078 discloses pipe forming apparatus in which a movable die is moved downwardly against a fixed die, and a flat metal blank is placed on the bottom die. The movable die includes two different portions, so that two different forming operations are accomplished by the movable die. After the tubular pipe is partially formed by the two dies, a pair of semicircular dies is then used to complete the rounding of the preformed tube. The semicircular dies include a movable portion and a fixed portion, with the preformed blank placed in the fixed portion.

U.S. Pat. No. 2,202,125 discloses pipe press apparatus for joining two pipes together. The pipes are of different diameters, and are pressed together by two semicircular dies. Explosive forces are used to move the upper, movable die downwardly against the lower, fixed die.

U.S. Pat. No. 2,903,929 discloses apparatus for swaging ferrules in which four die elements are used. The four elements are all movable and each comprise a quarter of a circle. The die elements utilize a combination of pivoting forces to bring the four portions together.

U.S. Pat. No. 4,445,357 discloses apparatus for forming pipe from a blank steel sheet. A plurality of hydraulic presses is used to form the pipe in two operations. Hydraulic presses operate in both an X and a Y direction, with the forming operation taking place in two steps, the first being actuation of the horizontally opposed X-direction presses, and the second operation being the actuation of the vertically moving Y-direction presses. The actuation of the X-direction presses forms a flat blank into a generally elongated U-configuration. Then, the actuation of the vertically oriented Y-direction presses completes the rounding of the U-shaped blank into a pipe.

According to the prior art, it is well known and understood that pipe elements or blanks may be rounded by the application of force to semicircular dies. However, what is not shown in the prior art is that a single machine may be utilized for squeezing off a pipe and then rerounding the pipe. It will be noted that the teachings of the prior art patents discussed above involve the rounding of pipe either from a blank or in reducing the diameter of an existing circular element. However, none of the patents disclose the rerounding of a deformed pipe, as with pipe that has been deliberately deformed or squeezed off.

The apparatus of the present invention is capable of both squeezing off pipe in a single operation, and then of rerounding the squeezed off pipe in a single operation. Thus, two independent operations are performed by the same apparatus, namely squeezing off pipe and then rerounding the squeezed off pipe.

SUMMARY OF THE INVENTION

The invention described and claimed herein comprises a frame having a fixed portion and a movable portion, with the fixed portion being adjustable for different pipe diameters. The squeeze-off apparatus includes two pins, with the pins secured to the two portions of the frame. The movable pin is limited in its movement by stops in accordance with the diameter of the pipe being squeezed off. Semi-circular reround elements are disposed on the squeeze-off pin elements for rerounding the squeezed-off pipe.

Among the objects of the present invention are the following

To provide new and useful apparatus for squeezing off and rerounding pipe;

To provide new and useful apparatus for squeezing off pipe having a fixed pin and a movable pin for squeezing off pipe disposed between the two pins;

To provide new and useful apparatus for rerounding pipe including a pair of semicircular elements for rerounding pipe disposed between the two elements;

To provide new and useful hydraulic apparatus for squeezing and rounding pipe;

To provide new and useful apparatus for squeezing pipe utilizing a frame having a fixed portion and a movable portion;

To provide new and useful apparatus for squeezing pipe by applying hydraulic pressure to a pair of pins and by rerounding the pipe by applying pressure to a pair of concave semicircular elements disposed between the pipes; and To provide new and useful apparatus for squeezing off pipe utilizing a pair of generally convex elements.

BRIEF DESCRIPTION OF THE DRAWING

FIG. 5 is a plan view of an element utilized in the apparatus of the present invention.

FIG. 6 is a front view of the apparatus of the present invention illustrating the operation thereof.

FIG. 7 is a side view in partial section of the apparatus of the present invention illustrating the operation thereof.

FIG. 8 is a side view in partial section of the apparatus of the present invention.

FIG. 9 is a front view of a portion of the apparatus of the present invention.

FIG. 10 is a front view of a portion of the apparatus of the present invention illustrating another mode of operation.

FIG. 11 is an end view in partial section of a portion of the apparatus of the present invention.

FIG. 12 is a view in partial section of an alternate embodiment of a portion of the apparatus of the present invention.

DESCRIPTION OF THE PREFERRED EMBODIMENT

Figure 1:
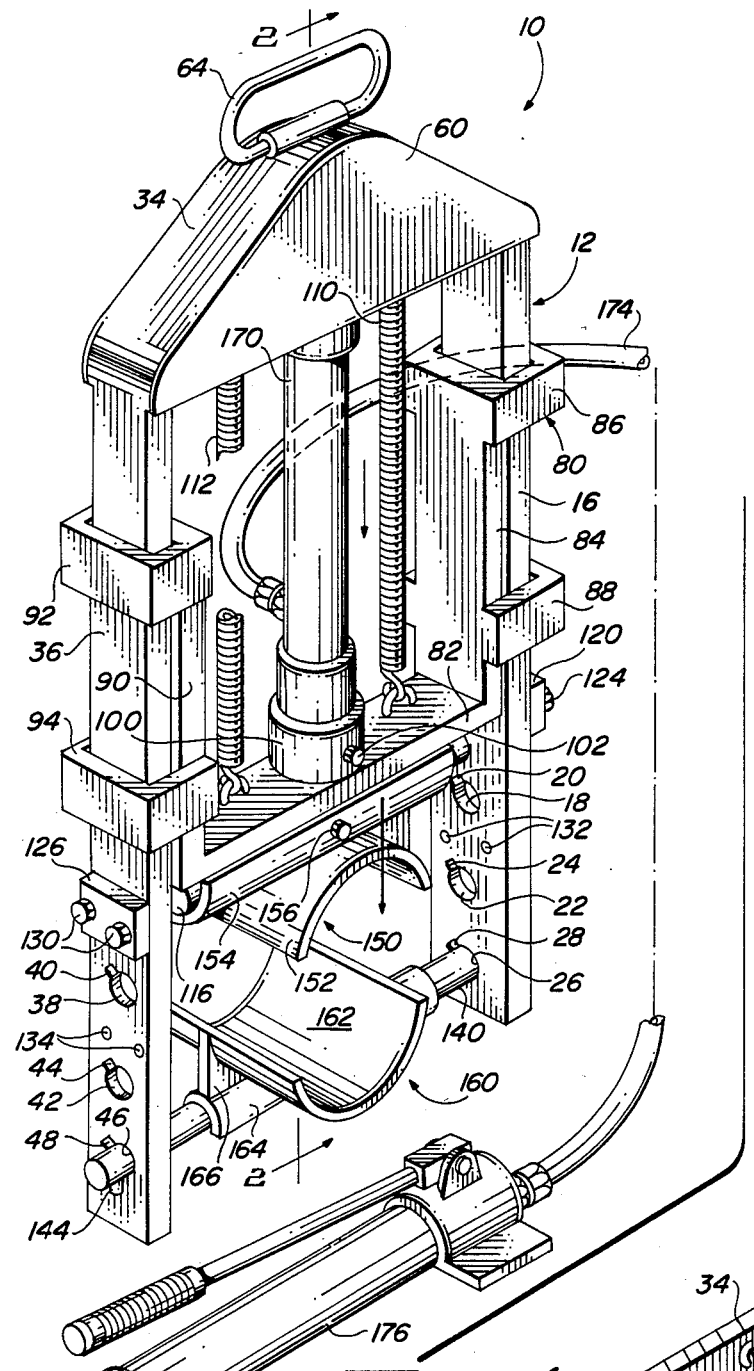
FIG. 1 is a perspective view of the apparatus of the present invention.

FIG. 1 is a perspective view of pipe squeeze-off and reround apparatus 10 embodying the present invention. The squeeze-off and reround apparatus 10 includes a fixed frame 12 and a movable frame 80. The fixed frame 12 includes a pair of lower side portions 16 and 36 which are spaced apart from each other and are generally parallel to each other. The side portions 16 and 36 are joined together at the top of the fixed frame 12 by a pair of upper side portions 14 and 34, respectively. The side portions 14 and 34 are continuations of the sides 16 and 36, respectively, which are simply bent or angled towards each other.

The movable frame 80 is disposed within the side portions 16 and 36 of the fixed frame 12, and is movable thereon. The movable frame 80 includes three primary structural elements or members, a bottom member or element 82 and a pair of side members or elements 84 and 90.

A hydraulic cylinder 170 is disposed on the movable frame 80 and is used in both the squeezing off and the rerounding functions of the apparatus 10. The cylinder 170 extends between the bottom frame member 82 of the movable frame 80 and the upper portion of the fixed frame 12.

Figure 2:
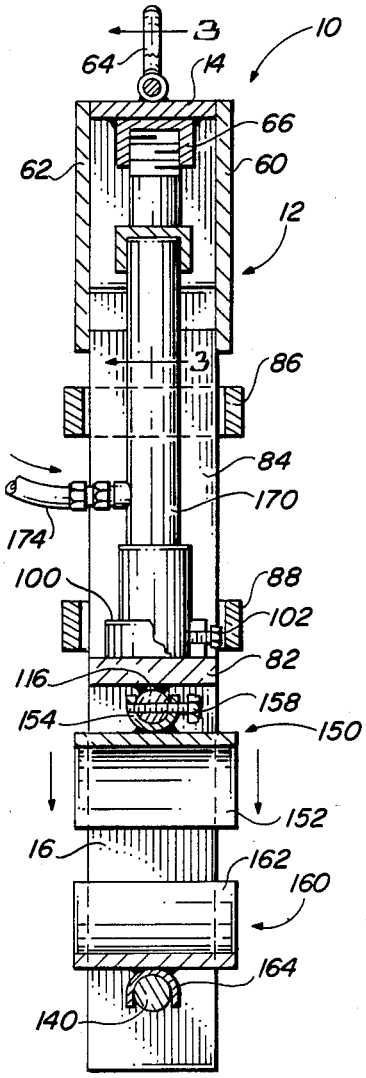
FIG. 2 is a view in partial section taken generally along line 2—2 of FIG. 1.

FIG. 2 is a view in partial section through the pipe squeeze-off and reround apparatus 10 of FIG. 1, taken generally alon line 2—2 of FIG. 1. FIG. 2 shows the lower side frame member 16, with the side member 84 of the movable frame 80 disposed thereon, and the hydraulic cylinder 170 extending between the upper portion 14 of the side frame member and the bottom member 82 of the movable frame 80.

Figure 4:
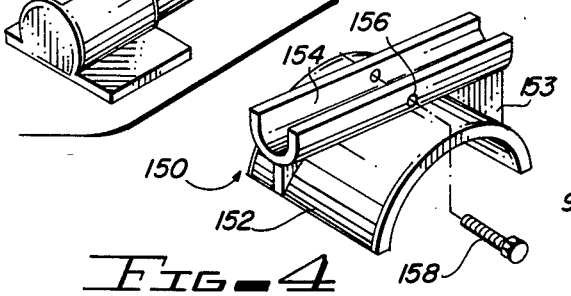
FIG. 4 is a perspective view of a portion of the apparatus of the present invention.
Figure 3:
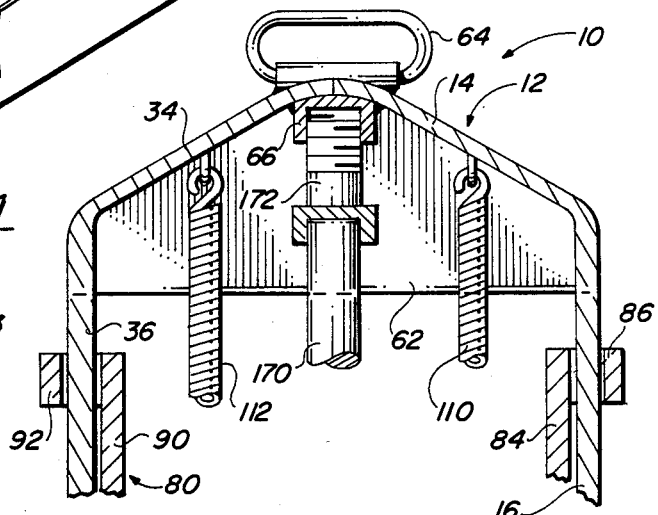
FIG. 3 is a view in partial section taken generally along line 3—3 of FIG. 2.

FIG. 3 is a view in partial section taken generally along line 3—3 of FIG. 2, showing the upper portions 14 and 36 of the fixed frame 12 and also the upper portions of the movable frame 80. FIG. 4 is a view in partial section of a rerounding fixture 150. The rerounding fixture 150 is the upper rerounding fixture. FIG. 5 is a plan view of a stop element 120.

For the following discussion concerning the pipe squeeze-off and rerounding apparatus 10, reference will primarily be made to FIGS. 1, 2, 3, 4, and 5.

The upper side portions 14 and 34 taper upwardly and inwardly towards each other from the lower side portions 16 and 36, respectively. A pair of triangular gussets 60 and 62 are secured to the opposite sides of the upper protions 14 and 34 of the fixed frame 12, and the lower portion of the gussets overlap slightly on the lower side portions 16 and 36. A handle 64 is secured to the top of the fixed frame 12 for convenience in transporting the apparatus 10.

As shown in FIGS. 2 and 3, a cup receptacle 66 is appropriate secured to the inner or inside top of the fixed frame, at about the juncture of the frame members 14 and 34. The cup receptacle 66 is internally threaded for receiving an externally threaded extension 172 of the hydraulic cylinder 170.

The lower portions 16 and 36 of the side frame members each include three slotted apertures. In the side member 16, there are apertures 18, 22, and 26. The aperture 18 includes a slot 20, the aperture 22 includes a slot 24, and the aperture 26 includes a slot 28. In the lower frame member 36 there are apertures 38, 42, and 46 The aperture 38 includes a slot 40, the aperture 42 includes a slot 44, and the aperture 46 includes a slot 48. All of the slots are radially extending and they extend radially outwardly a relatively short distance. The slots are not lined up on the vertical axis of the side frame members. Rather, the slots extend outwardly from the longitudinal or vertical axis of the frame members at about thirty to forty-five degrees.

Extending through the lower apertures 26 and 46 is a lower pin 140. The pin 140 is "fixed" in place, although it is movable to either of the other two pairs of slots. The pin 140 is placed in a pair of slots in accordance with the diameter of the pipe to be squeezed off and then rerounded.

The pin 140 includes a pair of ears which extend radially outwardly from the pin at a distance slightly more than the width of the fixed frame 12 from the outside of the frame members 16 and 36. An ear 144 is shown in FIG. 1. The length of the slots which extend radially outwardly from the apertures is slightly longer and slightly wider than the length and width of the ear 144 and its parallel ear on the opposite end of the pin 140. Thus, to insert the pin 140 into the fixed frame 12, the ears of the pin 140 are appropriately aligned with the slots 28 and 48 in the apertures 18 and 46 of the side frame members 14 and 36, respectively. Similarly, the ears are aligned with the slots to remove the pin and to install the pin in another pair of apertures. Actually, as will be understood, only one ear is moved through both slots. The other ear remains on the outside of the frame, as will be explained below.

The pin 140 is moved through the apertures, with an ear extending through the slots as the pin is moved. When the ears are on opposite sides of the fixed frame, the pin 140 is rotated so that the ears of the pin are no longer in alignment with the slots. The pin is then locked into place. It will be understood that by having the apertures misaligned, and not on a vertical or horizontal axis, the likelihood of a pin falling out due to an accidental alignment of the ears with the slots is remote. Moreover, if the slots on the apertures are not parallel to each other, and if the ears on the pin are parallel to each other, or vice versa, then an accidental ear and slot alignment so as to allow a pin to drop out is rather remote.

Within the lower portion of the fixed frame 12 is the movable frame 80. The movable frame 80 is in a generally U-shaped configuration. The movable frame 80 includes a transversely extending bottom element 82 and a pair of upwardly extending side elements 84 and 90. The side elements 84 and 90 are substantially perpendicular to the bottom element 82. The width of the movable frame 80, or of the three primary members 82, 84, and 90, is substantially the same as, or just a bit less than, the distance between the lower portions 16 and 36 of the fixed frame 12. To secure the movable frame 80 to the side members 16 and 36, brackets are used. A pair of brackets 92 and 94 are secured to the side member 90 and extend about the frame member 36. The movable frame 80 accordingly is disposed within the fixed frame 12 and moves vertically upwardly and downwardly with respect to the fixed frame 12.

Centered on the top of the bottom frame element 82 of the movable frame 80 is a cup receptacle 100. The hydraulic cylinder 170 is disposed within the cup receptacle 100 and is held therein by a set screw 102.

A pair of tension springs 110 are releasably secured to the bottom element 82 of the movable frame 80 and to the upper frame members 14 and 34, respectively. The tension springs 100 and 112 provide an upward bias for the movable frame 80.

For removing the hydraulic cylinder 170, the tension springs 110 and 112 are released, so that the hydraulic cylinder 170 may be lowered with the movable frame 80 and away from the upper portion of the fixed frame. The extension 172 is then removed from within the cup receptacle 66. Then, when the set screw 102 is released, the hydraulic cylinder 170 may be easily and conveniently removed for maintenance, etc.

The reinstallation of the hydraulic cylinder 170 is similarly easily and conveniently accomplished. The extension 172 is first threaded into the cup receptacle 66, the cylinder 170 is placed with the lower cup receptacle 100, and the set screw is tightened against the cylinder 170. Finally, the tension springs 110 and 112 are reinstalled between the frame members 14 and 34 of the fixed frame 12 and the transverse frame member 82 of the movable frame 80.

A pin 116 is appropriately secured, as by welding, to the underneath side of the bottom or transverse frame member 82 of the movable frame 80. The pin 116 is preferably a solid steel rod, and is of a diameter sufficient to allow the squeezing of pipe without structurally damaging the pipe, whether the pipe be plastic or metal. Extending diametrically through the pin 116 is an aperture 118.

Disposed on the outside of the lower frame members 16 and 36, respectively, is a pair of limit blocks 120 and 126. The limit blocks 120 and 126 are appropriately secured to the frame members 16 and 36 by screws, such as screws 124 and 130, respectively. The screws 124 and 130 extend into appropriate tapped apertures in the frame 12.

The limit blocks 120 and 126 limit the downward movement of the movable frame 80. They accordingly limit the extent of the squeezing of pipe disposed between the upper pin 116 and the lower pin 140. For squeezing and rerounding pipe of different diameters, the side frame members 16 and 36 include additional tapped apertures, such as the tapped apertures 132 and 134 shown in FIG. 1. The limit blocks 120 and 126 may accordingly be moved between the two locations. In FIG. 1, the limit blocks 120 and 124 are shown in their uppermost position.

The limit blocks are simply rectangular steel elements, with a pair of apertures extending through them for receiving the fastening screw elements. However, as shown in FIG. 5, the apertures 122 in the limit block 120 are disposed off center with respect to the horizontal axis of the block 120, so that the blocks each provide two different orientations and accordingly two different limits. That is, by inverting the limit blocks, but by still using the same apertures on the frame members, two different distances or limits are provided for the downward movement of the inner movable frame 80.

The use of the apparatus of the present invention is illustrated in FIGS. 6, 7, 8, 9, 10, and 11. In FIGS. 6, 7, 8, and 9, the squeezing off of a pipe is illustrated. In FIGS. 10 and 11, the rerounding of the pipe is illustrated.

In FIG. 6, which is a front view of the lower portion of the apparatus 10, the movable frame 12 is shown lifted upwardly, and the lower squeeze-off pin 140 is shown spaced apart from the frame 12. As indicated above, it is necessary that the pin 140 be removed in order to place the apparatus 10 over a pipe, such as a pipe 210, for the squeeze-off operation.

The pipe 200 may be either metal or plastic pipe. For purposes of illustration herein, the pipe 200 may be considered as a metal pipe.

After the apparatus 10 is disposed on the pipe 200, the pin 140 is installed in the frame 12. In the illustrations of FIGS. 6, 7, 8, and 9, the pin 140 is installed in the lowermost apertures 26 and 46 of the side frame members 14 and 36 respectively. The installation is accomplished by orienting the pin 140 so that the ear 142 is aligned with the slots 28 and 48 in the side frame members. Thus, if the pin 140 is to be installed from the left as shown in FIG. 6, the ear 142 is aligned with the slot 48 and then with the slot 28 as the pin is inserted through the apertures 46 and 26. After the installation of the pin 140, the pin is rotated so that the ears 142 and 144 are out of alignment with the slots 28 and 48 to prevent inadvertent removal of the pin 140. With the ears 142 and 144 rotated away from the slots 28 and 40, the pin 140 is secured or locked to the frame 12.

After installing the pin 140 in the frame 12, a hydraulic pump 176 (see FIG. 1) connected to the hydraulic cylinder 170, is actuated to cause the movable frame 80 to move downwardly. As the movable frame 80 moves downwardly by the action of the hydraulic cylinder 170, the upper pin 116 fixed to the movable frame 80 moves downwardly and contacts the pipe 200. As shown in FIGS. 8 and 9, the pipe 200 is deformed by the operation of the apparatus 10 to close the pipe and thus to "squeeze-off" the pipe to prevent a fluid, whether it be gaseous or a liquid fluid, from flowing through the pipe.

The squeeze-off operation deforms the pipe so that the pipe is widened as at 204 in the direction normal (perpendicular) to the squeeze-off force. This is shown in FIGS. 9 and 10. In FIGS. 9 and 10, a pinch-off area 202 is shown as a horizontally extending line between the walls of the pipe 200 and aligned with the widened area 204. The widened area 204 is an outwardly convex deformation of the pipe 200. Where the pins 116 and 140 contact the pipe 200, a concave deformity 206 forms.

Actually, the concave deformity 206 comprises a pair of concave deformities, just as the convex deformity 204 comprises a pair of convex deformities. As the pipe squeezes in at 206, it bulges out at 204.

The apparatus 10 may remain on the pipe 200, with hydraulic pressure applied, while the pipe 200 is being worked on. The apparatus 10 then acts as a clamp to insure that a leak through the closed off or pinched off area 202 does not occur while the pipe 200 is being worked on.

After the work has been accomplished on the pipe 200, and it is desired to restart the fluid flow through the pipe, the movable frame 80 is retracted preparatory to accomplishing the rerounding of the pipe. This is accomplished by releasing the hydraulic pressure from the pump 176 and the cylinder 170. As the hydraulic pressure is released, the inner movable frame 80 is retracted from the pipe 200 by the biasing action of the tension springs 110 and 112.

The upper rerounding fixture 150 includes a half-rounded concave, semi-circular or half-cylinder portion 152 and a socket portion 154. The two portions are appropriately secured together, as by welding. The socket portion 154 is adapted to receive, or to be disposed on, the pin 116. The socket 154 includes a pair of diametrically extending and aligned apertures 156 which receive a locking pin 158. The apertures 156 are aligned with the apertures 118 in the pin 116, and the pin 158 is then inserted to secure the fixture 150 to the pin 116. Gussets 153 reinforce the elements 152 and 154.

The longitudinal axis of the half round portion 152 is substantially perpendicular to the longitudinal axis of the socket portion 154.

The lower rerounding fixture 160 is substantially identical to the upper rerounding fixture 150, except that it need not include the apertures and pin for securing it to the pin 140. The fixture 160 includes a concave half-round or half-cylinder portion 162 and a socket portion 164. The longitudinal axes of the two portions are substantially perpendicular to each other. The two portions are also appropriately secured together, along with gussets 166, as by welding.

For the rerounding procedure, the rerounding fixture 150 is installed on the pin 116 and the second, lower, rerounding fixture 160 is installed on the pin 140. The upper rerounding fixture 150 is disposed on the pin 116 by disposing the socket 154 over the pin 116. After the socket 154 is disposed over the pin 116, the pin 150 is inserted through the apertures 156 in the socket 154 and the aperture 118 in the pin 116 to lock the upper rerounding fixture 150 to the pin 116.

The lower rerounding fixture 160 is disposed on the lower pin 140 by placing the socket 164 over the pin 140. If desired, the lower rerounding fixture 160 may also be pinned to the lower pin 140, but such pinning may not be necessary. As illustrated herein, the lower rerounding fixture 150 is shown without a locking pin engagement.

For the rerounding stage or procedure, the apparatus 10 is rotated ninety degrees from the generally vertical orientation illustrated in FIGS. 6, 7, 8, and 9. The ninety degree rotation, as shown in FIG. 10, places the widest portion of the pipe 200, the deformed portion 204, against the center of the half-round elements 152 and 162 of the rerounding fixtures 150 and 160, respectively. The rerounding force is thus applied against the pipe 200 in the deformed area 204 by the center portions of the concave half-round elements 152 and 162.

For the rerounding procedure, the hydraulic pump 176 is again actuated to cause movement of the movable frame 80 towards the fixed pin 140. It will be noted that the rerounding fixtures will automatically center themselves with respect to the pipe 200, as can be imagined from FIG. 10. As the half-round elements 152 and 162 are moved together by the hydraulic force acting through the hydraulic cylinder 170 from the hydraulic pump 176, the deformity in the pipe 200 is substantially removed so that the rerounding of the pipe is relatively complete. The fluid flow through the pipe is accordingly re-established.

As best illustrated in FIG. 11, the rerounding procedure does not provide, particularly in metal pipe, a perfectly or completely rerounded pipe. While the fluid flow through the pipe is restored substantially completely, some deformation in the pipe remains. The pipe as rerounded includes a slight convex portion on the interior of the pipe, and a slight concavity, such as identified by reference numeral 208 in FIG. 11 on the exterior of the pipe. In FIG. 10, the exterior concavity 206 is very pronounced, since it is adjacent to the squeezed off or pinched off area 202. The outer concavity 208 is shown in FIG. 11 as a minimal concavity or depression after the rerounding procedure has been accomplished.

With plastic pipe, the rerounding is substantially complete, due to the greater inherent elasticity of the plastic pipe. However, in metal pipe, some residual deformity, such as the residual exterior concavity 208 shown in FIG. 11, remains.

FIG. 12 is a view in partial section through an alternate embodiment of an upper squeeze-off pin 216. The upper squeeze-off pin 216 is, like the upper squeeze-off pin 116 discussed above in conjunction with FIGS. 1–9, secured to the movable frame 80. The difference between the pin 216 and the pin 116 is the cross-sectional configuration of the pin 216. The pin 116 is shown as being substantially circular or cylindrical in cross-sectional configuration, while the pin 216 is not circular in its cross-sectional configuration.

The pin 216 includes a pair of relieved or machined sides 210 and 220 which extend upwardly from a bottom radius portion 222. The configuration of the radius portion 222 is that of a cylinder having the same radius as the circular or semi-circular portion of the pin 216. However, the sides adjacent to the radius portion 222 are relieved, as shown, to define a pair of relatively flat and sloping sides 210 and 220. The purpose for the relieved or machined sides 210 and 220 is to provide a tapered, or modified "V" configuration for the upper squeeze-off pin to provide additional squeezing ability against a pipe.

The crimping power or ability of the apparatus is substantially enhanced by the modified "V" configuration of the upper pin 216, while yet maintaining the cylindrical or circular cross-sectional configuration of the lower pin 140. For some applications, the modified design pin 216 may be advantageous, while in other applications the circular cylindrical pin 116 may be preferable.

The sloping sides 210 and 220 are both relatively flat, and they blend in with the radius or cylindrical portion of the pin 216 at both the bottom, crimping portion 222 and the upper cylindrical surface which extends between the sides 210 and 220 remote from the bottom crimping portion or surface 222.

For securing a rerounding fixture, such as the rerounding fixture 150, to the pin 216 on the movable frame, the configuration of the socket element or member 154 may be modified to receive the modified "V" cross-sectional configuration of the pin 216.

The generally circular cross-sectional configuration of the lower, fixed pin 140 may also be modified, if desired. However, the use of the modified "V" cross-sectional configuration for the upper, movable pin with a generally circular cross-sectional configuration of the lower pin has been demonstrated to provide sufficient crimping power without the need for modifying the cross-sectional configuration of the bottom, fixed pin, also. With the enhanced crimping ability of the upper pin 216, the retention of the cylindrical configuration for the bottom or lower pin 140, pipe is smoothly squeezed off without structural damage so that rerounding may be effected to restore fluid flow through the pipe.

The pair of gussets 153, secured between the half-round elements 152 and the socket 154, reinforces the area of the rerounding fixture 150 where pressure is applied during the rerounding procedure. Similarly, the pair of gussets 166, secured between the half-round element 162 and the socket 164, reinforces the area of the rerounding fixture 160 where pressure is applied during the rerounding procedure. All of the gussets are, as stated, preferably welded to the respective rerounding elements.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Apparatus for squeezing off and for rerounding pipe, comprising, in combination:

fixed frame means;

first pin means removably secured to the fixed frame means;

movable frame means disposed on the fixed frame means and movable relative thereto;

second pin means secured to the movable frame means;

first rerounding means disposed on the first pin means;

second rerounding means disposed on the second pin means; and means for moving the movable frame means relative to the fixed frame means for first squeezing off a pipe between the first pin means and the second pin means and then for rerounding the squeezed off pipe between the first and second rerounding means when the first and second rerounding means are disposed on the first and second pin means.

2. The apparatus of claim 1 in which the fixed frame means includes a first frame member and a second frame member spaced apart from each other, and the pipe to be squeezed off is positioned between the first and second frame members.

3. The apparatus of claim 2 in which the movable frame means is disposed on the first and second frame means and is movable thereon.

4. The apparatus of claim 3 in which the means for moving the movable frame means relative to the fixed frame means includes hydraulic means extending between the fixed frame means and the movable frame means.

5. The apparatus of claim 4 in which the fixed frame means further includes an upper portion secured to the first and second frame members, and the hydraulic means extends between the upper portion and the movable frame means.

6. The apparatus of claim 4 in which the fixed frame means further includes means for biasing the movable frame means relative to the fixed frame means to move the second pin away from the first pin.

7. The apparatus of claim 6 in which the means for biasing the movable frame means includes a tension spring extending between the upper portion of the fixed frame means and the movable frame means.

8. The apparatus of claim 3 in which the movable frame means includes a first side portion disposed against the first frame member of the fixed frame means, a second side portion disposed against the second frame member of the fixed frame means, a bottom member extending between the first and second side portions, and bracket means for movably securing the first and second side portions to the first and second frame members.

9. The apparatus of claim 8 in which the fixed frame means further includes stop means for limiting the movement of the movable frame means relative to the fixed frame means.

10. The apparatus of claim 9 in which the stop means includes a limit block secured to the first frame member and adapted to be contacted by the bracket means to stop the movement of the movable frame means.

11. The apparatus of claim 10 in which the limit block is adapted to be secured in a plurality of locations to vary the location at which the movable frame means stops to accommodate pipes of different diameters.

12. The apparatus of claim 10 in which the limit block is adapted to be secured in a plurality of orientations to vary the location at which the movable frame means stops to accommodate pipes of different diameters.

13. The apparatus of claim 1 in which the first rerounding means includes a first socket portion adapted to receive and to be disposed on the first pin means and a first half round portion adapted to receive the squeezed off pipe, and the second rerounding means includes a second socket portion adapted to receive and to be disposed on the second pin means and a second half round portion adapted to receive the squeezed off pipe, and the squeezed off pipe is rerounded by moving the movable frame means relative to the fixed frame means whereby the first and second half round portions are moved towards each other with the squeezed off pipe in the half round portions.

14. The apparatus of claim 13 in which the second rerounding means further includes means for securing the second socket portion to the second pin.

* * * * *